US010794372B2

(12) United States Patent
Matsumoto

(10) Patent No.: US 10,794,372 B2
(45) Date of Patent: Oct. 6, 2020

(54) SHOE FOR COMPRESSOR

(71) Applicant: Taiho Kogyo Co., Ltd., Toyota-shi, Aichi (JP)

(72) Inventor: Kensaku Matsumoto, Toyota (JP)

(73) Assignee: Taiho Kogyo Co., Ltd., Toyota-shi, Aichi (JP)

( * ) Notice: Subject to any disclaimer, the term of this patent is extended or adjusted under 35 U.S.C. 154(b) by 0 days.

(21) Appl. No.: 16/326,555

(22) PCT Filed: Sep. 27, 2017

(86) PCT No.: PCT/JP2017/034873
§ 371 (c)(1),
(2) Date: Feb. 19, 2019

(87) PCT Pub. No.: WO2018/062232
PCT Pub. Date: Apr. 5, 2018

(65) Prior Publication Data

US 2019/0186479 A1 Jun. 20, 2019

(30) Foreign Application Priority Data

Sep. 30, 2016 (JP) ..... 2016-195109

(51) Int. Cl.
*F04B 27/08* (2006.01)

(52) U.S. Cl.
CPC ..... *F04B 27/0886* (2013.01)

(58) Field of Classification Search
CPC ..... F04B 27/0886
See application file for complete search history.

(56) References Cited

U.S. PATENT DOCUMENTS 4,683,804 A * 8/1987 Futamura ..... F01B 3/0073 92/71
6,276,905 B1 8/2001 Yoshitaka
8,734,124 B2 5/2014 Hatta et al.
(Continued)

FOREIGN PATENT DOCUMENTS

CN 1385610 12/2002
CN 101144467 3/2008
(Continued)

OTHER PUBLICATIONS

International Search Report (PCT/ISA/210) dated Dec. 19, 2017, by the Japanese Patent Office as the International Searching Authority for International Application No. PCT/JP2017/034873.
(Continued)

*Primary Examiner* — Abiy Teka
*Assistant Examiner* — Michael Quandt
(74) *Attorney, Agent, or Firm* — Buchanan Ingersoll & Rooney PC

(57) ABSTRACT

There is provided a shoe for a compressor with improved seizure resistance. The shoe for the compressor includes: a first sliding face that slides on a piston; a second sliding face that slides on a swash plate; and a recess formed in the second sliding face. In a section along a height direction and scaled up 1000 times in the height direction and 10 times in a radial direction, a connecting portion between the second sliding face and the recess 53 is formed in a rounded shape with a radius R2 larger than 5 mm.

4 Claims, 7 Drawing Sheets

(56) References Cited

U.S. PATENT DOCUMENTS

| | | | | |
|---|---|---|---|---|
| 2003/0000379 | A1* | 1/2003 | Sugiura ..... | F04B 27/0886 92/71 |
| 2003/0024381 | A1 | 2/2003 | Miyazawa et al. | |
| 2009/0151552 | A1 | 6/2009 | Kato et al. | |
| 2015/0308271 | A1 | 10/2015 | Satake et al. | |

FOREIGN PATENT DOCUMENTS

| | | | |
|---|---|---|---|
| CN | 104884796 | | 9/2015 |
| EP | 1 342 919 | A2 | 9/2003 |
| JP | 61167178 | A | 7/1986 |
| JP | 2002332959 | A | 11/2002 |
| WO | 2007/096285 | A1 | 8/2007 |

OTHER PUBLICATIONS

Written Opinion (PCT/ISA/237) dated Dec. 19, 2017, by the Japanese Patent Office as the International Searching Authority for International Application No. PCT/JP2017/034873.
Office Action issued issued in corresponding Chinese Patent Application No. 201780057892.0, dated Aug. 21, 2019 (15 pages).
Extended European Search Report issued in corresponding European Patent Application No. 17856181.7, dated Feb. 4, 2020 (8 pages).

* cited by examiner

SHOE FOR COMPRESSOR

TECHNICAL FIELD

The present invention relates to a technique of a shoe for a compressor.

BACKGROUND ART

Conventionally, there is a known technique of a shoe for a compressor. For example, such a technique is described in Patent Literature 1.

In Patent Literature 1, a shoe (a shoe for a compressor) having a sliding face that slides on a swash plate is described. A hole is formed in the sliding face of the shoe. The shoe can retain lubricant in the hole, which improves seizure resistance.

However, in the technique described in Patent Literature 1, if the shoe has an acute-angled edge between the sliding face and the hole or at an outer peripheral end portion of the sliding face, for example, the edge may break an oil film in some cases. As a result, oil film formation between the shoe and the swash plate is obstructed, which may reduce the seizure resistance.

CITATION LIST

Patent Literature

Patent Literature 1: Japanese Patent Application Laid-open No. 61-167178

SUMMARY OF INVENTION

Technical Problem

The present invention has been made with the above-described circumstances in view and an object of the present invention is to provide a shoe for a compressor with improved seizure resistance.

Solution to Problem

The problem to be solved by the present invention is as described above and a solution to the problem will be described next.

In other words, a shoe for a compressor according to the invention includes: a first sliding face that slides on a piston; a second sliding face that slides on a swash plate; and a recess formed in the second sliding face. In a section along a height direction and scaled up 1000 times in the height direction and 10 times in a radial direction, a connecting portion between the second sliding face and the recess is in a rounded shape with a radius larger than 5 mm.

A shoe for a compressor according to the invention includes: a first sliding face that slides on a piston; a second sliding face that slides on a swash plate; and a recess formed in the second sliding face. In a section along a height direction and scaled up 1000 times in the height direction and 10 times in a radial direction, a connecting portion between the second sliding face and the first sliding face is in a rounded shape with a radius larger than 5 mm.

A shoe for a compressor according to the invention includes: a first sliding face that slides on a piston; a second sliding face that slides on a swash plate; and a recess formed in the second sliding face. In a section along a height direction and scaled up 1000 times in the height direction and 10 times in a radial direction, a connecting portion between the second sliding face and the recess is in a rounded shape with a radius larger than 5 mm and a connecting portion between the second sliding face and the first sliding face is formed in a rounded shape with a radius larger than 5 mm.

The second sliding face is formed to bulge from the connecting portion connected to the first sliding face toward the connecting portion connected to the recess.

Advantageous Effect of Invention

According to the present invention, it is possible to improve the seizure resistance.

DESCRIPTION OF EMBODIMENT

Figures used in the following description are schematic views where dimensions and the like of respective portions are exaggerated if necessary for convenience of explanation.

Figure 1:
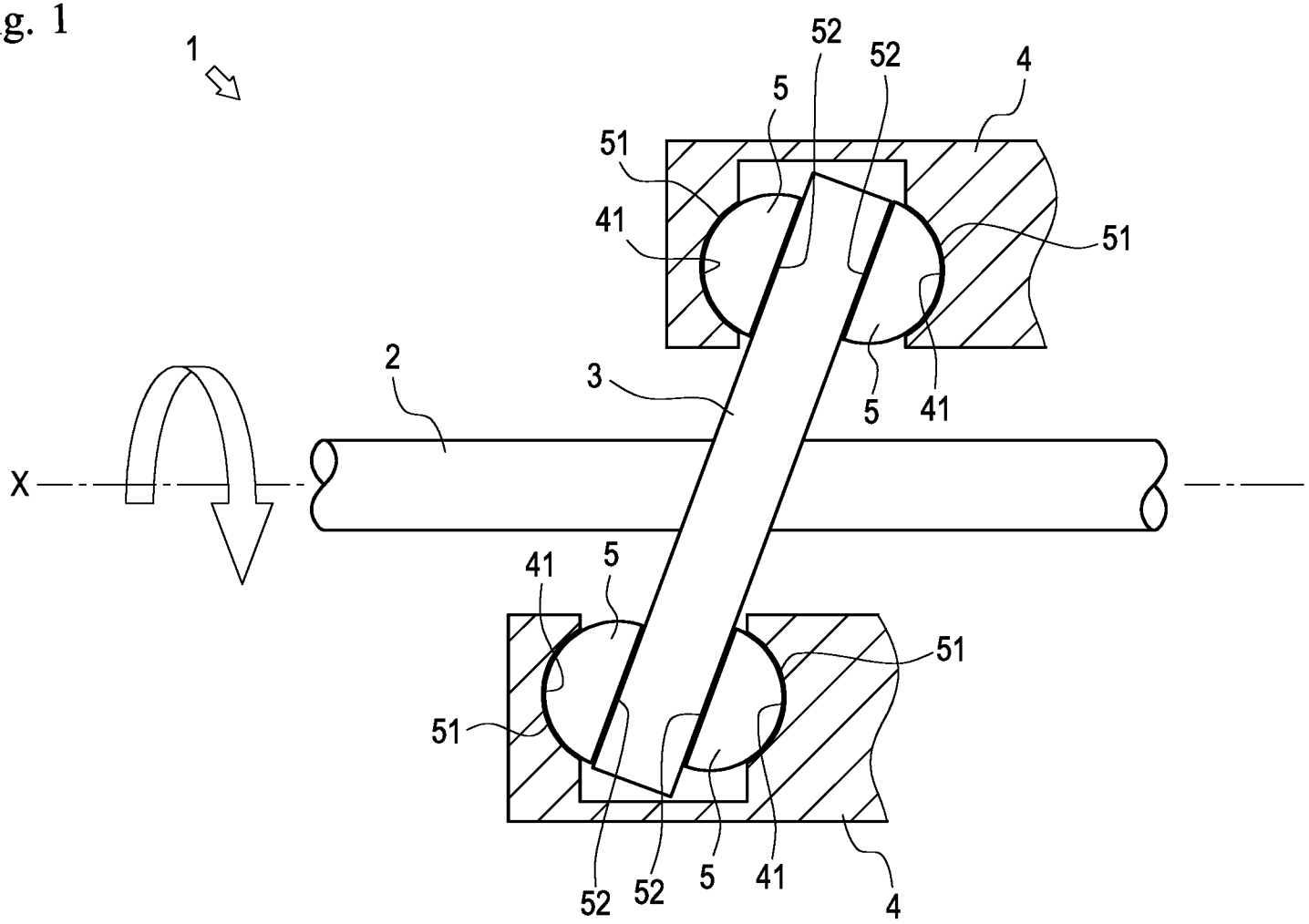
FIG. 1 is a partially-sectional side view of a schematic configuration of a compressor according to an embodiment.
Figure 2A:
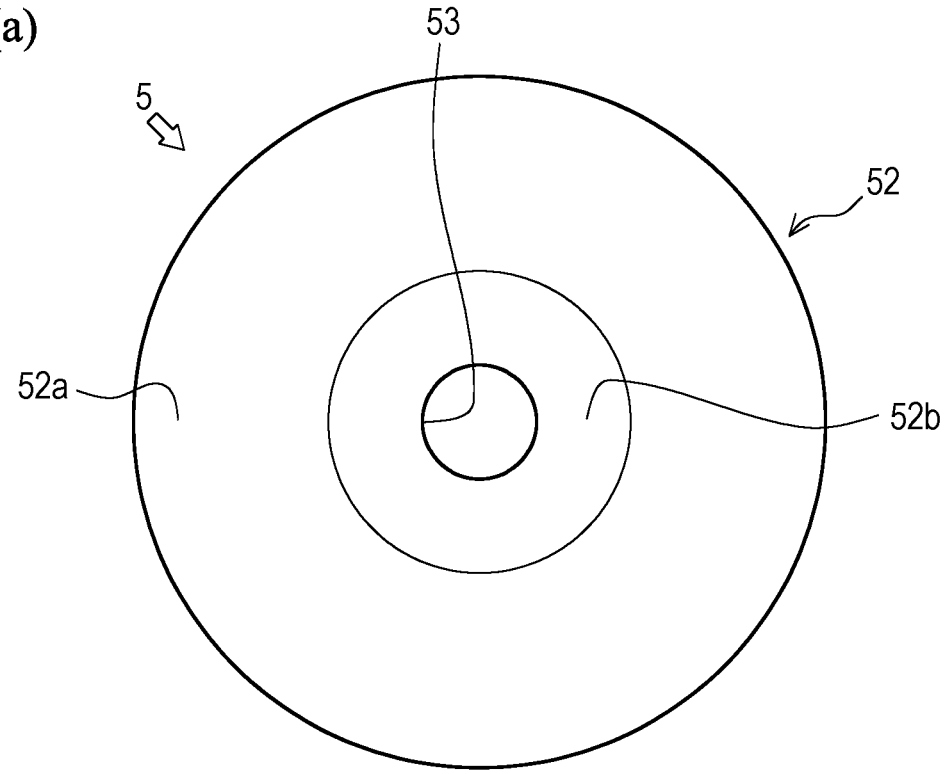
FIG. 2(*a*) is a plan view of a shoe, and FIG. 2(*b*) is a side view of the shoe.
Figure 2B:
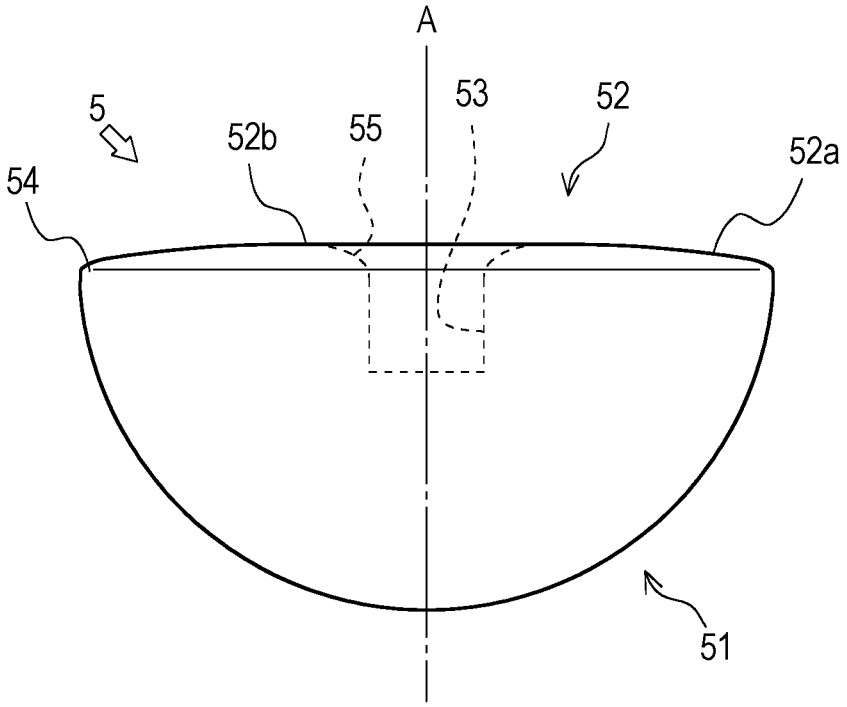
Figure 3:
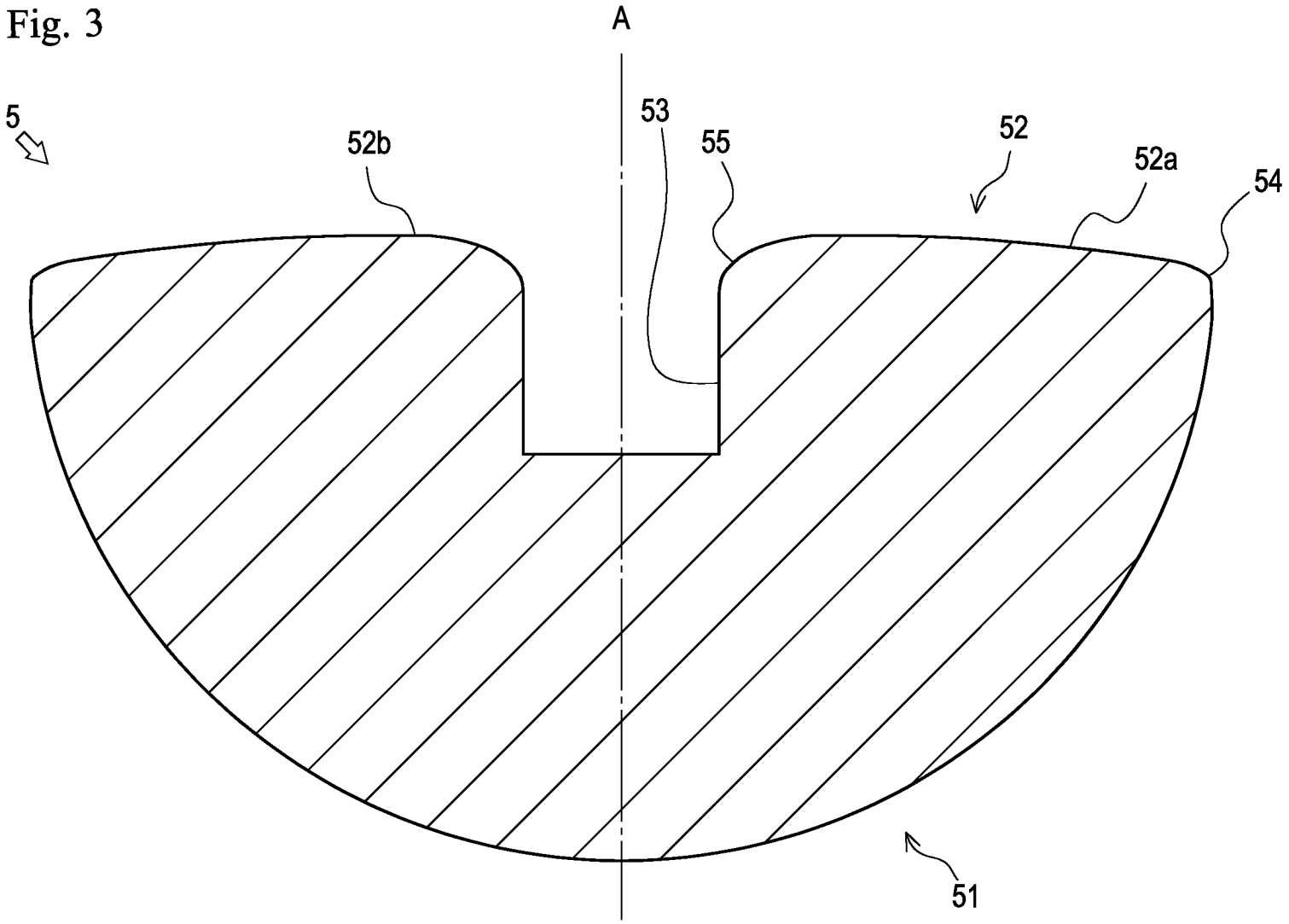
FIG. 3 is a side sectional view of the shoe.

With reference to FIGS. 1 to 3, an overview of a configuration of a compressor 1 according to a first embodiment of the present invention will be described below. The compressor 1 mainly includes a rotating shaft 2, a swash plate 3, pistons 4, and shoes 5.

The rotating shaft 2 shown in FIG. 1 is rotatably supported by a housing (not shown). The rotating shaft 2 is rotated by power from a drive source (not shown).

The swash plate 3 is formed in a circular flat plate shape. The rotating shaft 2 is inserted through a central portion of the swash plate 3. The swash plate 3 is provided to a middle portion of the rotating shaft 2 while inclined with respect to an axial direction of the rotating shaft 2.

The pistons 4 are respectively disposed in a plurality of cylinder bores (not shown) formed in the housing. Each of the pistons 4 is provided to be able to slide (reciprocate) along the axial direction of the rotating shaft 2. Recesses 41 are formed in each of the pistons 4.

The recesses 41 are formed inside the piston 4. Each of the recesses 41 is formed in a substantially hemispherical shape. The pair of recesses 41 is formed in each of the pistons 4 so that the recesses 41 face each other along the axial direction of the rotating shaft 2.

Each of the shoes 5 shown in FIGS. 1 to 3 is formed in a substantially hemispherical shape. To put it concretely, each of the shoes 5 mainly has a first sliding face 51, a second sliding face 52, and a recess 53. For the purpose of explanation, an imaginary line (imaginary axis A) extending in a height direction of the shoe 5 and passing through a center of the shoe 5 is shown if necessary in the figures.

The first sliding face 51 is a face on one side of the shoe 5 and a face that slides in the recess 41 in the piston 4 (see FIG. 1). The first sliding face 51 is formed on the one side (e.g., a lower side of FIG. 2(*b*)) in a direction of the imaginary axis A (the height direction of the shoe 5). The first sliding face 51 is formed to bulge toward the one side. The first sliding face 51 is formed in a shape of a hemispherical face conforming to the recess 41 in the piston 4.

The second sliding face 52 is a face on the other side of the shoe 5 and a face that slides on the swash plate 3 (see FIG. 1). The second sliding face 52 is formed on the other side (e.g., an upper side of FIG. 2(*b*)) in the direction of the imaginary axis A (the height direction of the shoe 5). The second sliding face 52 is formed to slightly bulge toward the other side, i.e. the opposite side from the first sliding face 51. The second sliding face 52 is formed in a shape with a smaller bulge width than the first sliding face 51 (a shape similar to a flat shape). The second sliding face 52 has an outer peripheral portion 52*a* and a central portion 52*b*.

The outer peripheral portion 52*a* forms an outer portion of the second sliding face 52. The outer peripheral portion 52*a* is provided along an outer periphery of the second sliding face 52. The outer peripheral portion 52*a* is formed in a shape of a curved face having a considerably larger radius of curvature than the first sliding face 51.

The central portion 52*b* forms an inner portion of the second sliding face 52. The central portion 52*b* is formed in a circular shape. The central portion 52*b* is provided on an inner side of the outer peripheral portion 52*a* (at a center of the second sliding face 52) to be continuous with the outer peripheral portion 52*a*. The central portion 52*b* is formed in a substantially flat shape. More specifically, the central portion 52*b* is formed in the flat shape or a shape of a curved face having a larger radius of curvature than the outer peripheral portion 52*a*.

The recess 53 is formed by recessing the second sliding face 52 toward the first sliding face 51. The recess 53 is formed at a center of the central portion 52*b* of the second sliding face 52. The recess 53 is formed to have a predetermined depth (such a depth as not to go through the first sliding face 51).

The shoes 5 are made of a sintered material, a resin material, and the like besides iron-based, cupper-based, and aluminum-based materials. Especially, it is preferable to manufacture the shoes 5 by forging or rolling SUJ2.

The shoes 5 formed in this manner are respectively disposed in the recesses 41 in the pistons 4. At this time, each of the shoes 5 is disposed so that the first sliding face 51 and the recess 41 come in contact with each other to be able to slide (rock). In this way, the two shoes 5 disposed in the one piston 4 are disposed with the second sliding faces 52 opposed to each other. A portion close to an outer peripheral portion of the swash plate 3 is pinched between the second sliding faces 52 of the two shoes 5.

When the rotating shaft 2 rotates in the compressor 1 configured in this manner, the swash plate 3 also rotates with the rotating shaft 2. Because the swash plate 3 is inclined with respect to the axial direction of the rotating shaft 2, the swash plate 3 causes the pistons 4 to reciprocate (slide) in the axial direction through the shoes 5. At this time, the second sliding faces 52 of the shoes 5 slide on surfaces of the swash plate 3. Because the recess 53 is formed in the second sliding face 52 of each of the shoes 5, the shoe 5 can retain lubricant in the recess 53. Therefore, it is possible to facilitate formation of an oil film between the shoe 5 and the swash plate 3 to thereby improve seizure resistance.

The shape of each of the shoes 5 will be described below more specifically.

Figure 4:
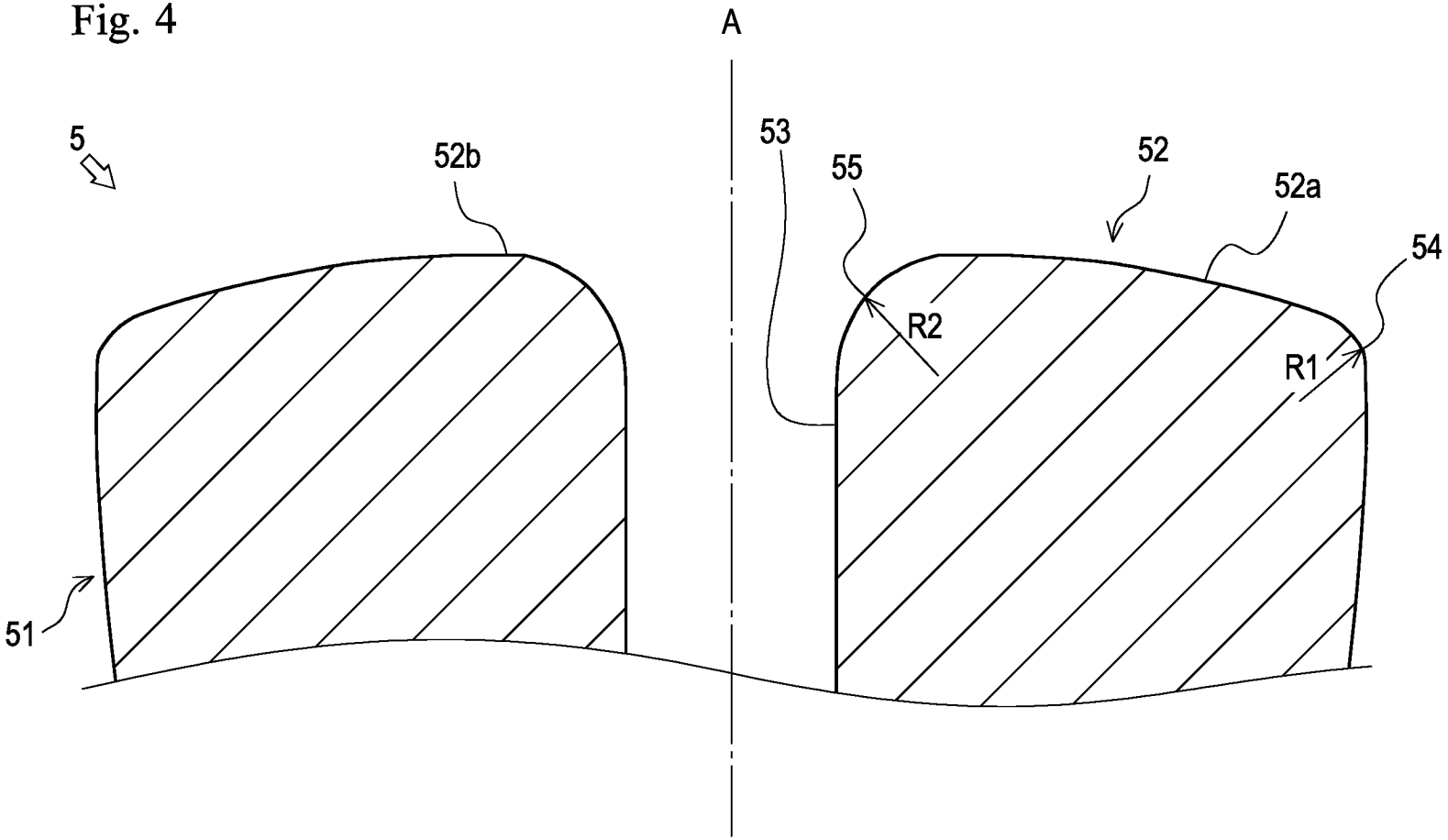
FIG. 4 is an appropriately-enlarged schematic view of a side section of the shoe.

In each of the shoes 5 according to the embodiment, shapes of a connecting portion 54 between the second sliding face 52 and the first sliding face 51 and a connecting portion 55 between the second sliding face 52 and the recess 53 are worked out so as not to obstruct the oil film formation (see FIG. 4). The shapes of the connecting portion 54 and the connecting portion 55 will be concretely described below.

FIG. 4 is an appropriately-enlarged schematic view of a side section (section along a height direction) of the shoe 5. In FIG. 4, the shoe 5 is scaled up 1000 times in a vertical direction (a scaling factor of the height direction of the shoe 5) and 10 times in a lateral direction (a scaling factor of a radial direction (a direction perpendicular to the imaginary axis A) of the shoe 5). In other words, FIG. 4 shows the side section (especially, a portion around the second sliding face 52) of the shoe 5 with a vertical scaling factor which is 100 times a lateral scaling factor.

In the section shown in FIG. 4 (vertical scaling factor: lateral scaling factor=1000:10), the connecting portion 54 between the second sliding face 52 and the first sliding face 51 is formed in a curved shape (a rounded shape). In the section shown in FIG. 4, a radius (a radius of curvature) R1 of the connecting portion 54 is larger than 5 mm.

In the section shown in FIG. 4, the connecting portion 55 between the second sliding face 52 and an inner side face of the recess 53 is formed in a curved shape (a rounded shape). In the section shown in FIG. 4, a radius (a radius of curvature) R2 of the connecting portion 55 is larger than 5 mm.

In this manner, in the embodiment, the radius R1 of the connecting portion 54 and the radius R2 of the connecting portion 55 are relatively large (larger than 5 mm). As a result, the connecting portion 54 and the connecting portion 55 are less likely to break the oil film and the oil film formation between the shoe 5 and the swash plate 3 is less likely to be obstructed.

Figure 5:
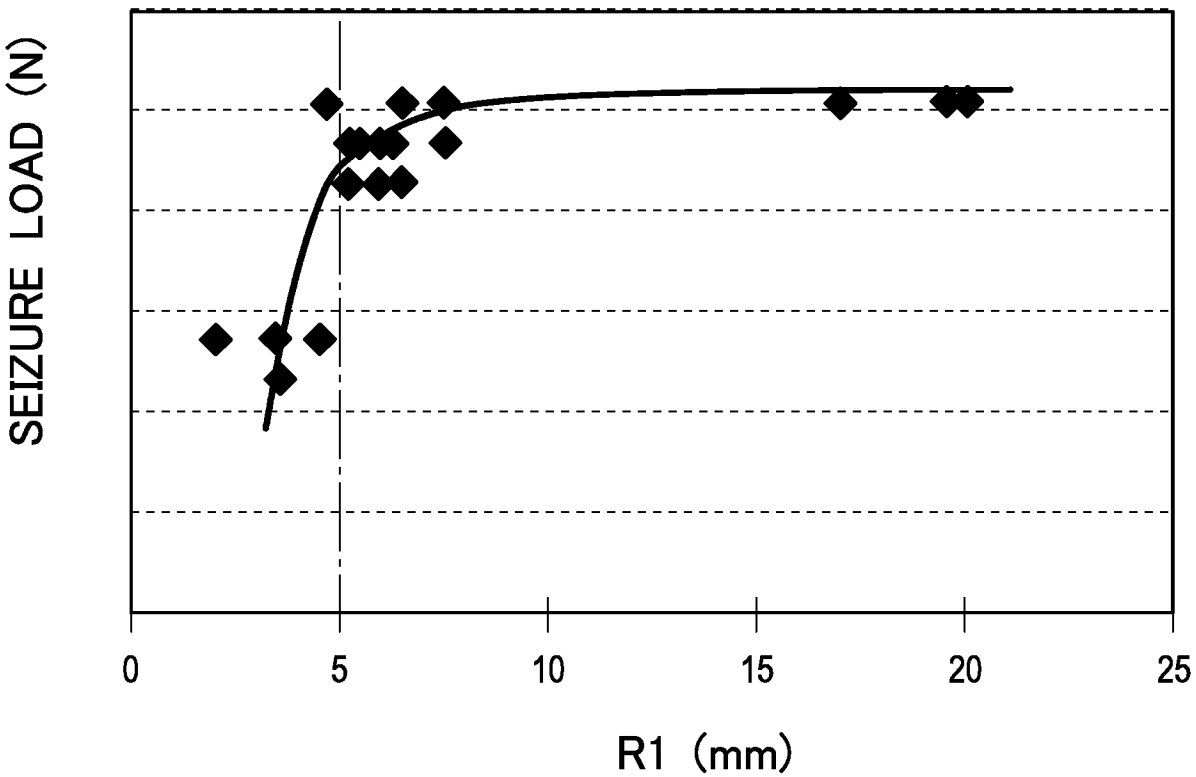
FIG. 5 is a graph showing measurement results of a seizure load according to a radius of a connecting portion between a second sliding face and a first sliding face.
Figure 6:
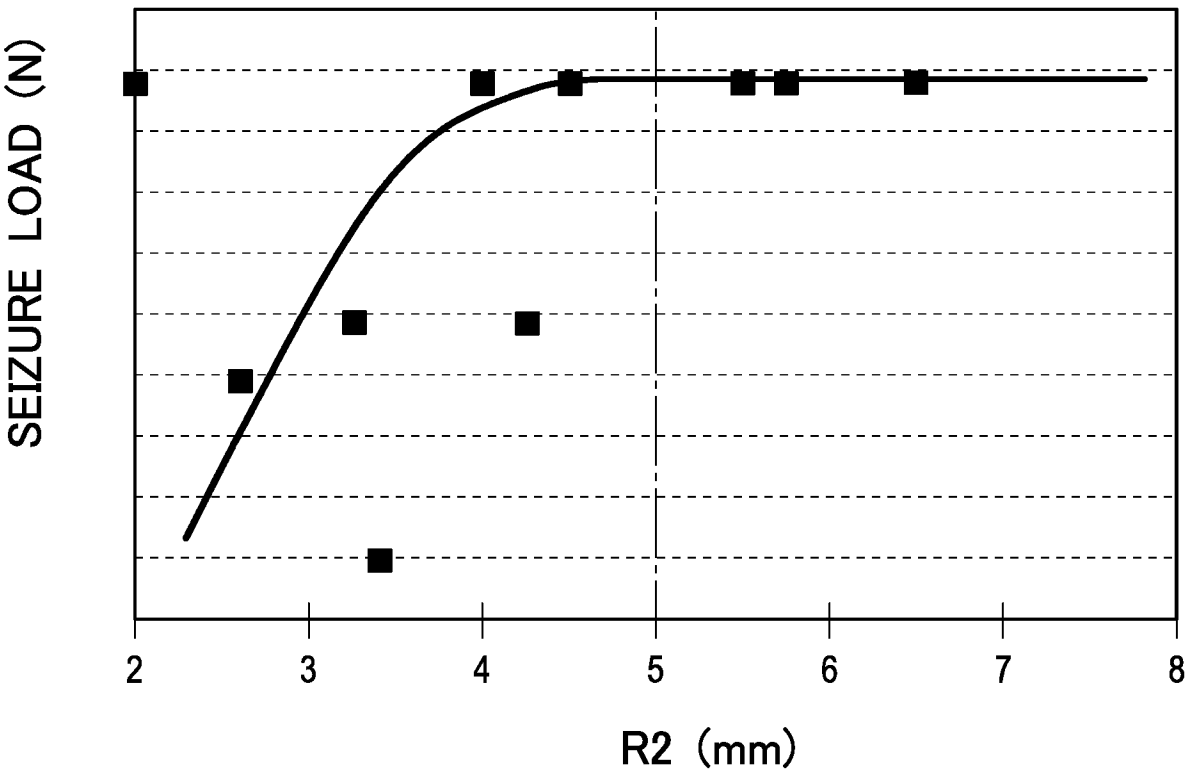
FIG. 6 is a graph showing measurement results of a seizure load according to a radius of a connecting portion between the second sliding face and a recess.

FIGS. 5 and 6 show results of measurement of seizure loads (N) of the shoe 5 according to the radius R1 and the radius R2 by experiments. From the results according to the radius R1 shown in FIG. 5, the seizure load is low when the radius R1 is 5 mm or smaller while the seizure load is stably high when the radius R1 is larger than 5 mm. From the results according to the radius R2 shown in FIG. 6, similarly, the seizure load is low when the radius R2 is 5 mm or smaller while the seizure load is stably high when the radius R2 is larger than 5 mm.

From the results, each of the shoes 5 according to the embodiment is formed to have the radius R1 and the radius R2 which are larger than 5 mm.

A shape of the second sliding face 52 of each of the shoes 5 according to the embodiment is worked out to effectively facilitate the oil film formation. The shapes of the connecting portion 54 and the connecting portion 55 will be concretely described below.

Figure 7A:
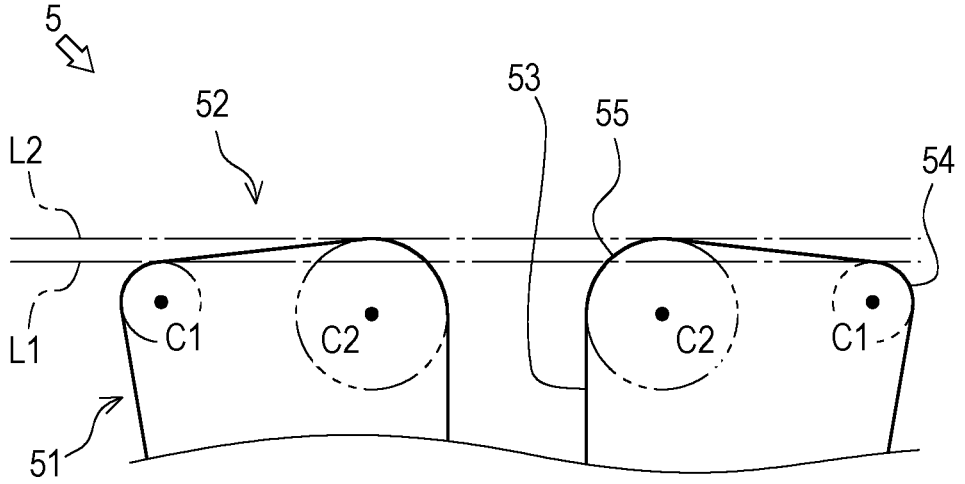
FIG. 7(*a*) is a side sectional schematic view of the shoe showing common tangents to circles of curvature of the connecting portions, and FIG. 7(*b*) is a side sectional schematic view of the shoe showing another common tangent.
Figure 7B:
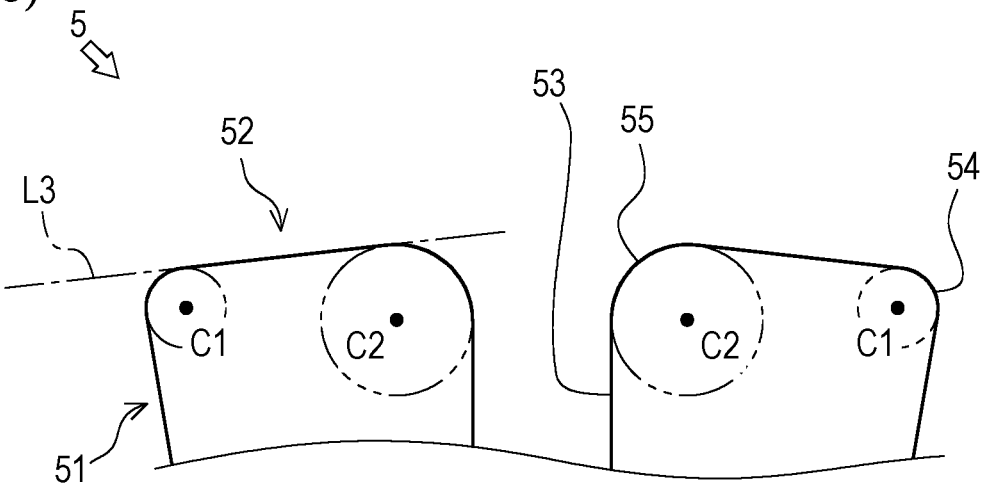

As shown in schematic views in FIGS. 7(*a*) and 7(*b*), the second sliding face 52 of the shoe 5 is formed to bulge from an outer peripheral end portion (the connecting portion 54 connected to the first sliding face 51) toward a central end portion (the connecting portion 55 connected to the recess 53).

To put it concretely, as shown in FIG. 7(*a*), when a common tangent to the circles C1 of curvature of the connecting portions 54 (the symmetric circles C1 of curvature with respect to a center of the second sliding face 52) (more specifically, a common external tangent drawn on an upper side of the circles C1 of curvature in the figure) is L1 and a common tangent to the circles C2 of curvature of the connecting portion 55 (more specifically, a common external tangent drawn on an upper side of the circles C2 of curvature in the figure) is L2, the common tangent L2 is positioned above the common tangent L1 in the figure. As a result, the second sliding face 52 is formed to bulge from the outer peripheral end portion toward the central end portion.

Moreover, as shown in FIG. 7(*b*), when a common tangent to the circle C1 of curvature of the connecting portion 54 and the circle C2 of curvature of the connecting portion 55 (more specifically, a common external tangent drawn on an upper side of the circle C1 of curvature and the circle C2 of curvature in the figure) is L3, the second sliding face 52 does not have a portion positioned below the common tangent L3 in the figure. In other words, the second sliding face 52 is formed on or above the common tangent L3 in the figure.

Furthermore, the second sliding face 52 is formed to gradually bulge upward in the figure from the outer peripheral end portion toward the central end portion. In other words, the second sliding face 52 is formed to extend without being recessed downward on its way from the outer peripheral end portion to the central end portion.

In the embodiment, with the second sliding face 52 formed in this manner, it is possible to effectively facilitate the oil film formation between the shoe 5 and the swash plate 3 by wedge effect. As a result, it is possible to improve the seizure resistance.

As described above, the shoe 5 (the shoe for the compressor) according to the embodiment includes: the first sliding face 51 that slides on the piston 4; the second sliding face 52 that slides on the swash plate 3; and the recess 53 formed in the second sliding face 52. In the section along the height direction and scaled up 1000 times in the height direction and 10 times in the radial direction, the connecting portion 55 between the second sliding face 52 and the recess 53 is formed in the rounded shape with the radius R2 larger than 5 mm.

With this configuration, it is possible to improve the seizure resistance.

The shoe 5 according to the embodiment includes: the first sliding face 51 that slides on the piston 4; the second sliding face 52 that slides on the swash plate 3; and the recess 53 formed in the second sliding face 52. In the section along the height direction and scaled up 1000 times in the height direction and 10 times in the radial direction, the connecting portion 54 between the second sliding face 52 and the first sliding face 51 is formed in the rounded shape with the radius R1 larger than 5 mm.

With this configuration, it is possible to improve the seizure resistance.

The shoe 5 according to the embodiment includes: the first sliding face 51 that slides on the piston 4; the second sliding face 52 that slides on the swash plate 3; and the recess 53 formed in the second sliding face 52. In the section along the height direction and scaled up 1000 times in the height direction and 10 times in the radial direction, the connecting portion 55 between the second sliding face 52 and the recess 53 is formed in the rounded shape with the radius R2 larger than 5 mm and the connecting portion 54 between the second sliding face 52 and the first sliding face 51 is formed in the rounded shape with the radius R1 larger than 5 mm.

With this configuration, it is possible to improve the seizure resistance.

The second sliding face 52 according to the embodiment is formed to bulge from the connecting portion 54 connected to the first sliding face 51 toward the connecting portion 55 connected to the recess 53.

With this configuration, it is possible to improve the seizure resistance.

Although the embodiment of the invention has been described above, the invention is not limited to the above-described configurations and can be changed in various ways without departing from a scope of the invention described in the claims.

For example, although the radius R1 of the connecting portion 54 and the radius R2 of the connecting portion 55 are larger than 5 mm in the embodiment, it is possible to improve the seizure resistance by making at least one of the radiuses R1 and R2 larger than 5 mm.

Although the shoe 5 with the recess 53 formed in the second sliding face 52 is shown as an example in the embodiment, the invention is not limited to it and can be applied to a shoe without a recess 53 in a second sliding face 52. In this case, a connecting portion 54 between a first sliding face 51 and a second sliding face 52 is formed in a rounded shape with a radius R1 larger than 5 mm.

The compressor 1 may be a compressor in which an inclination angle of the swash plate 3 is variable (what is called "variable displacement type") or the inclination angle is invariable (what is called "fixed displacement type").

INDUSTRIAL APPLICABILITY

The present invention is applicable to the shoe for the compressor.

REFERENCE SIGNS LIST

1: Compressor
2: Rotating shaft
3: Swash plate
4: Piston
5: Shoe
51: First sliding face
52: Second sliding face
53: Recess
54: Connecting portion
55: Connecting portion

The invention claimed is:

1. A shoe for a compressor comprising:
a first sliding face that slides on a piston;
a second sliding face that slides on a swash plate; and
a recess formed in the second sliding face,
wherein, in a section along a height direction of the shoe and scaled up 1000 times in the height direction and 10 times in a radial direction of the shoe, a connecting portion between the second sliding face and the recess is formed in a rounded shape with a radius of curvature larger than 5 mm, and the radius of curvature of the connecting portion between the second sliding face and the recess is larger than a radius of curvature of a connecting portion between the second sliding face and the first sliding face.

2. The shoe for the compressor according to claim 1, wherein the second sliding face is formed to bulge from a connecting portion between the second sliding face and the first sliding face toward the connecting portion between the second sliding face and the recess.

3. A shoe for a compressor comprising:
a first sliding face that slides on a piston;

a second sliding face that slides on a swash plate; and a recess formed in the second sliding face, wherein, in a section along a height direction of the shoe and scaled up 1000 times in the height direction and 10 times in a radial direction of the shoe, a connecting portion between the second sliding face and the first sliding face is formed in a rounded shape with a radius larger than 5 mm, a radius of curvature of the connecting portion between the second sliding face and the recess is larger than a radius of curvature of a connecting portion between the second sliding face and the first sliding face.

4. The shoe for the compressor according to claim 3, wherein the second sliding face is formed to bulge from the connecting portion between the second sliding face and the first sliding face toward a connecting portion between the second sliding face and the recess.

* * * * *